US007288355B2

(12) United States Patent
Kamikoriyama et al.

(10) Patent No.: US 7,288,355 B2
(45) Date of Patent: Oct. 30, 2007

(54) CARRIER FOR ELECTROPHOTOGRAPHY DEVELOPERS, DEVELOPER PREPARED BY USING THE CARRIER AND METHOD FOR FORMING IMAGE

(75) Inventors: Yoichi Kamikoriyama, Saitama (JP); Kenji Suzuoka, Saitama (JP); Takashi Nakashima, Saitama (JP); Kazuya Kinoshita, Saitama (JP); Yuji Sato, Chiba (JP); Hiromichi Kobayashi, Chiba (JP); Takeshi Gondo, Chiba (JP); Takashi Hikichi, Chiba (JP)

(73) Assignees: Mitsui Mining & Smelting Co., Ltd., Tokyo (JP); Powdertech Co., Ltd., Chiba (JP)

( * ) Notice: Subject to any disclaimer, the term of this patent is extended or adjusted under 35 U.S.C. 154(b) by 277 days.

(21) Appl. No.: 10/861,083

(22) Filed: Jun. 4, 2004

(65) Prior Publication Data

US 2004/0248015 A1 Dec. 9, 2004

(30) Foreign Application Priority Data

Jun. 4, 2003 (JP) ..... 2003-158860

(51) Int. Cl.
*G03G 9/107* (2006.01)

(52) U.S. Cl. ..... 430/111.3; 430/111.31

(58) Field of Classification Search ..... 430/111.3, 430/111.31

See application file for complete search history.

(56) References Cited

U.S. PATENT DOCUMENTS 5,565,291 A * 10/1996 Mayama et al. ..... 430/111.34
5,885,741 A * 3/1999 Akamastu et al. ..... 430/111.1
6,130,019 A * 10/2000 Nishikawa et al. ..... 430/111.35
6,593,417 B1 * 7/2003 Anderson et al. ..... 524/588

FOREIGN PATENT DOCUMENTS

| | | |
|---|---|---|
| EP | 0 408 399 A | 1/1991 |
| EP | 0 535 598 A | 4/1993 |
| EP | 0 785 242 A | 7/1997 |
| JP | 59-048774 A | 3/1984 |
| JP | 62-296156 A | 12/1987 |

(Continued)

*Primary Examiner*—John L Goodrow
(74) *Attorney, Agent, or Firm*—The Webb Law Firm, P.C.

(57) ABSTRACT

Provided are a carrier for electrophotography developers prepared by generating a slight amount of byproducts such as water, alcohol, etc, which carrier is free from release of a magnetic powder, has excellent mechanical strength and durability, and good environmental stability, and further can restrain occurrence of toner spent condition and has favorable fluidity and excellent capability of imparting charging to a toner, a two-component developer comprising the carrier and a method for forming an image using the developer. The carrier for electrophotography developers comprises a magnetic powder dispersed binder resin, the binder resin material comprises (A) a polysiloxane compound having an epoxy group as a functional group and (B) a polysiloxane compound having a group capable of ring-opening addition reaction with the epoxy group of the polysiloxane compound (A), and the binder resin is a silicone resin prepared by curing with ring-opening addition reaction of the epoxy resin. The developer comprises the carrier for electrophotography developers and the toner particle. The method for forming an image comprises developing a static latent image by the developer with an alternating electric field.

26 Claims, 1 Drawing Sheet

FOREIGN PATENT DOCUMENTS

| | | | |
|---|---|---|---|
| JP | 02-220068 | A | 9/1990 |
| JP | 02-272577 | A | 11/1990 |
| JP | 05-040367 | A | 2/1993 |
| JP | 05-100496 | A | 4/1993 |
| JP | 5113696 | * | 5/1993 |
| JP | 08-286428 | A | 11/1996 |
| JP | 08-334931 | A | 12/1996 |
| JP | 10-039549 | A | 2/1998 |

* cited by examiner

CARRIER FOR ELECTROPHOTOGRAPHY DEVELOPERS, DEVELOPER PREPARED BY USING THE CARRIER AND METHOD FOR FORMING IMAGE

BACKGROUND OF THE INVENTION

1. Field of the Invention

The present invention relates to a magnetic powder dispersed binder type carrier for electrophotography developers which carrier is used in developing an electrostatic latent image formed by an electrophotography method or electrostatic printing method, a two-component developer for electrophotography containing this carrier and a method for forming an image using this two-component type developer for electrophotography.

2. Description of the Prior Art

A method of developing an electrophotography is a method of developing by adhering toner particles present in a developer onto an electrostatic latent image formed on a photosensitive material. The developers used in this method are classified into a two-component developer composed of toner particles and carrier particles and a one-component developer composed of only toner particles.

Among the developing methods with these developers, as the developing method using such a two-component developer composed of toner particles and carrier particles, a cascade development method has been employed formerly but at present, a magnetic brush developing method using a magnet roller is mainly employed.

The carrier particles contained in the two-component developer are stirred with the toner particles in a developing box filled with the developer and thereby impart desired electric charge to the toner particles, and further act as a carrier substance for transporting the charged toner particles to the surface of a photosensitive material in order to form a toner image on the photosensitive material. The carrier particles remaining on a developing roller with magnetism return to the developing box from the developing roller again, and are mixed and stirred with new toner particles. In this way, the carrier particles are used repeatedly for a certain period of time.

Different from the one-component developer, the two-component developer has a function such that the carrier particles are mixed and stirred with the toner particles to charge the toner particles and further to transport them. Therefore, the two-component developer has good controllability in designing the developer. Accordingly, the two-component developer is suitable for a full color developing device in need of having high image quality and a first printing device in need of having reliability for keeping image and durability.

The two-component developer thus used needs to have image properties such as image density, fog, white spots, tone properties and resolving power which properties show the prescribed values from an initial stage and further, even if using the developer for a long period of time, are stably maintained without change. In order to maintain these properties stably, the carrier particles contained in the two-component developer need to have stable properties.

The carrier particles forming the two-component developer used conventionally are iron powder carriers such as iron powder which surface is covered with oxide and iron powder which surface is covered with a resin. The iron carriers have high magnetization and high conductivity so that they have merits capable of easily preparing image of good reproducibility in a solid part.

The iron powder, however, has a heavy own weight and too high magnetization. On this account, when the iron powder is stirred and mixed with toner particles in a developing box, fusion of the toner to the surface of the irons powder carrier, that is, toner-spent condition is apt to occur. Due to the occurrence of the toner-spent condition, the effective carrier surface area is decreased and thereby the triboelectric charging capability with the toner particles is apt to be lowered.

With regard to the resin-coated iron powder carrier, the surface resin is peeled off by stress received from use for a long period of time and thereby a core material (iron powder) having high conductivity and a low dielectric breakdown voltage is exposed to induce leak of electric charge occasionally. The leak of electric charge breaks electrostatic latent image formed on a photosensitive material and thereby brush traces and the like are generated in a solid part so that uniform image is hardly prepared and the durability is inferior. For the above reasons, iron carriers including the oxide coated iron powder and the resin coated iron powder have been scarcely used at the present state.

Recently, as shown in JP-A-59 (1984)-48774, in place of the iron carriers, resin-coated ferrite carriers having a light true specific gravity of about 5.0, prepared by using a ferrite having low magnetization as a core material which surface is coated with a resin have been used frequently and the life of developers is prolonged greatly.

However, recently, as office networking is progressing, copy machines have progressed from single functional copy machines to multi-functional machines, and further the service system has shifted from such a system that periodical maintenance, for example, replacement of developers or the like is conducted by service engineers under contact, to a maintenance free system. The demand for prolonging the lifetime of the developers has further arisen in the market.

In offices, full color images are recognized so that the demand for high image quality has been increased and the diameters of toner particles are decreased for attaining high resolution.

For coping with such demands, it is necessary to charge toners with desired electricity quickly. For the sake of necessity, the particle diameter of carriers has been shifted to be small and the specific surface area thereof has been large. When the whole particle size distribution is shifted to the direction that the particle size is diminished, scattering or adhesion of the carrier particles having a small particle diameter to a photosensitive material is easily induced and thereby fatal image defects such as white omission and the like are easily induced. Consequently, the problems of the two-component developer are more revealed. Accordingly, the carriers having a small particle diameter are required to be controlled so as to further narrow the width of the particle size distribution.

For solving the above problems, many magnetic powder dispersed binder type carriers obtainable by dispersing fine magnetic powder in a resin are proposed with the aim of reducing the weight of the carrier particles and prolonging the life of the developers.

For example, JP-A-Hei 5(1993)-40367 discloses a carrier for electrostatic latent image development obtainable by kneading a resin and a magnetic powder and then pulverizing and classifying. However, such a magnetic powder dispersed binder type carrier prepared by the pulverization method easily induces leak of electric charge because the magnetic powder is exposed on the surface in pulverization, and further electrical scattering of the carrier to a photosensitive material cannot be decreased and consequently the life of the carrier is short under the present conditions. The carrier, further, has inferior environmental stability in charging due to excessive exposure of the magnetic powder. Additionally, the shapes of the carrier particles after the pulverization and classification are not uniform so that the surface areas of the particles are different from each other in the carrier. Furthermore, the fluidity of the developer is inferior so that the charge imparting capability toward the toner is uneven. As a result, quick charging capability is not obtained and thereby high quality image is not obtained. The operation environment in the pulverization step is not good, and further the pulverization step brings productive deterioration with lowering of the yield because the particle size distribution of the resulting carrier particles is widened.

To cope with these problems, for obtaining a spherical magnetic powder dispersed binder type carrier without passing through pulverization and classification steps, JP-A-Hei 2(1990)-220068 discloses a magnetic carrier, which comprises complex particles of ferromagnetic fine particles and a cured phenol resin and is obtainable by reacting and curing a phenol and an aldehyde in an aqueous medium. JP-A-Hei 8(1996)-334931 discloses a binder type carrier obtainable by suspension polymerization of isocyanate, a phenol and an aldehyde with heating under stirring in the presence of a magnetic powder. JP-A-Sho 62(1987)-296156 discloses a carrier obtainable by melt kneading a polyolefin thermoplastic resin and a magnetic fine powder, followed by spraying, cooling and solidifying.

As described above, various binder resins capable of dispersing and combining fine magnetic powders are disclosed for the magnetic powder dispersed binder type carriers. The curing phenol resin, however, has a high critical surface tension so that toners are easily fused and thereby induce toner spent condition in the use thereof. Further, the curing phenol resin invites a lowering of charging and has a short life. Further, the curing phenol resin has a benzene ring, it has such problems that the environmental dependency is high and the image quality is largely changed under high temperature and high humidity or low temperature and low humidity conditions.

The thermoplastic resin easily induces image defects such as white spots and the like because it has low heat resistance and carrier particles scattered are molten and solidified on a fuser roller. The polyolefin resin originally has low charging capability toward toners with negative polarity and easily induces toner scattering or fog so that sufficient image quality cannot be obtained.

JP-A-Hei 5(1993)-100496 discloses a binder type carrier in which a magnetic powder is dispersed in resin particles, obtainable by suspension polymerization of a composition containing a polymerizable monomer such as styrenes and the like, a silicone compound having a group capable of reacting with the polymerizable monomer, a cross-linking agent and a magnetic powder, in an aqueous medium.

However, when a binder phase is formed by polymerizing the polymerizable monomer such as styrene, methyl methacrylate and like, and the silicone compound capable of reacting with the monomer in the presence of the cross-linking agent and the magnetic powder, a uniform copolymer cannot be obtained and a polymer composition is distributed because the reactivity of the polymerizable monomer such as styrenes etc and that of the silicone compound are different each other. Furthermore, these polymers have inferior compatibility and thereby induce phase separation. As a result, sufficient mechanical strength cannot be obtained and the charging properties of the carrier particles vary with the result that high quality image cannot be obtained. Additionally, unreacted materials having a low molecular weight are remained and thereby not only the environmental dependency, which is one of the carrier properties becomes worse but also the mechanical strength of the carrier particles is low, the magnetic powders are released and the carrier has inferior durability. When the content of the silicone compound is increased in order to improve the spent resistance, the above problems tend to be exhibited markedly as described in this publication. At the present state, for the demands of further prolonging the life of developers and improving the image quality by improving the resistance to spent toner, mar resistance and mechanical strength, sufficient carriers are not prepared.

JP-A-Hei 8(1996)-286428) discloses a developer for color electrophotography characterized in that a binder resin of magnetic matter dispersed carrier particles comprises a silicone resin as an essential component.

The magnetic matter dispersed carrier particles containing the silicone resin as an essential component wherein the curing reaction of the silicone resin is a molecular elimination-condensation reaction, as described in this publication, easily cause voids generated by evaporation of byproducts having a low molecular weight or internal cracks caused by the change in specific gravity (volume) at the condensation time. Recently, developing apparatuses have been desired to be downsized, however, the magnetic matter-dispersed carrier prepared by this publication cannot sustain increase of stirring stress in a downsized developing apparatus and further it is difficult to prevent deterioration of the charging properties caused by release of the magnetic powder. Furthermore, similar to JP-A-Hei 5(1993)-100496, in the case of mixing the silicone resin and other resins as a binder resin, the silicone resin has inferior compatibility with the other resins so that phase separation is easily caused in the inside of the binder resin phase and further it is difficult to prepare carrier particles having uniform charging properties and sufficient mechanical strength.

Furthermore, as described in the publication, the case of preparing a magnetic powder dispersed binder type resin carrier using, as a binder resin, silicone resin fine particles such as F200 and R900 manufactured by Dow Corning Toray Silicone Co., Ltd has the following many problems. Because of the properties of this resin, pulverization and classification steps are indispensable. Accordingly, as the carrier shape is un-uniform, the surface areas of the carrier particles are different from each other. Further, as the fluidity of the developer is inferior, the capability of imparting charging toward toners is un-uniform. Therefore, the capability of quick charging cannot be attained and also high quality image cannot be obtained.

The silicone resin or silicone modified resin as disclosed in this publication is a solid silicone resin already prepared or a varnish containing a solvent. For preparing a spherical magnetic powder dispersed binder type carrier without the steps of pulverization and classification, even when the preparation will be tried through a polymerization method or a production step of suspending in an aqueous medium and curing, it is difficult to incorporate these silicone resins in an originally solid state into the preparation process. Further, the silicone varnish including a solvent easily induces voids because a large amount of solvent components contained in the varnish evaporates in curing. Furthermore, the mechanical strength of the resulting particles lowers and also particles having a uniform particle diameter and a uniform shape cannot be prepared with dispersing and maintaining the magnetic powder uniformly. Therefore, this publication cannot solve the above problems essentially.

JP-A-Hei 2(1990)-272577 discloses a magnetic carrier prepared by dispersing magnetic powder and conductive fine particles in a binder resin formed from a silicone resin containing an organic tin compound. When the silicone resin is used as an essential component and the carrier is prepared with condensation reaction in the presence of an organic tin catalyst, large amounts of byproducts such as water, alcohol etc are generated. Due to the generation of the byproducts, voids are generated inside the carrier and simultaneously due to change in specific gravity (volume), cracks are easily generated to lower the strength of the carrier. Additionally, release of the magnetic powder is easily induced, the charged amount thereof is markedly decreased and sufficient durability cannot be attained. Therefore, the carrier is not a sufficient one.

When the carrier is prepared by condensation reaction using the silicone resin as an essential component and the organic tin catalyst, the organic tin compounds remains in an end product. The organic tin compounds are widely known as an endocrine disturbing chemical (environmental hormone) similar to formaldehyde. Taking the recent environmental problems into consideration, it is desired to avoid the use of such a substance in the preparation.

JP-A-Hei 10(1998)-39549 discloses a magnetic matter dispersed resin carrier which surface is covered with a resin composition at least containing a straight silicone resin and a coupling agent. The adhesion between the outer surface silicone resin layer and the magnetic powder dispersed binder resin layer as described in this publication is low so that during the use, the covered resin is easily released and the magnetic powder present in the exposed carrier core material surface is easily released. As a result, the charging and the resistance are changed to invite deterioration of the image quality.

It is an object of the invention to provide a carrier for electrophotography developers which is produced with slightly generating byproducts such as water, alcohol etc, without release of a magnetic powder, and has high mechanical strength, excellent durability and good environmental stability, and further can control toner spent condition, and has good fluidity and excellent capability of imparting charging to a toner.

It is another object of the invention to provide a two-component type developer containing the above carrier for electrophotography developers having the above properties.

It is a further object of the invention to provide a method for forming an image by using the above two-component developer by an alternating electric field.

SUMMARY OF THE INVENTION

The carrier for electrophotography developers of the present invention comprises a magnetic powder dispersed binder resin, and is obtainable by mixing a binder resin material and a magnetic powder, suspending a resulting mixture in an aqueous medium and curing a suspension.

The binder resin material comprises:

(A) a polysiloxane compound having an epoxy group as a functional group and (B) a polysiloxane compound having a group capable of ring-opening addition reaction with the epoxy group of the polysiloxane compound (A).

The binder resin is a silicone resin prepared by hardening with the ring-opening addition reaction of an epoxy group.

Specifically, the carrier for electrophotography developers of the invention is a carrier for electrophotography developers in which the magnetic powder is dispersed in the binder resin. The carrier comprises, as essential components, (A) the polysiloxane compound having an epoxy group as a functional group and (B) the polysiloxane compound having a group capable of ring-opening addition reaction with the epoxy group of the polysiloxane compound (A) and is one in which the magnetic powder is dispersed in the silicone resin cured by the ring-opening addition reaction with an epoxy group.

The polysiloxane compound (B) having a functional group capable of ring-opening addition reaction with an epoxy group desirably has at least one functional group selected from the group consisting of an amino group, carboxyl group, mercapto group and carbinol group.

The polysiloxane compound (A) having an epoxy group desirably has an epoxide equivalent weight of from 200 to 1500 g/mol.

The polysiloxane group (B) having a group capable of ring opening addition reaction with the above epoxy group desirably has an equivalent weight of a function group capable of ring opening addition reaction with the epoxy group of from 100 to 4000 g/mol.

The ratio of the number of functional groups of the polysiloxane compound (A) to the number of functional groups of the polysiloxane compound (B) (the number of epoxy groups of the polysiloxane groups (A)/the number of functional groups of the polysiloxane compound (B), which functional groups are capable of ring opening addition reaction of the epoxy groups is desirably in the range of from 0.3 to 3.0.

The mixture of the polysiloxane (A) and the polysiloxane (B) desirably has a change in the specific gravity before and after heating of from 0.8 to 1.2.

The mixture of the polysiloxane (A) and the polysiloxane (B) more desirably has a change in the weight before and after heating of from 0.8 to 1.0.

In the reaction of the binder resin, a byproduct is produced in an amount of preferably less than 20 parts by weight based on 100 parts by weight of the weight of the compounds constituting the binder resin before curing.

The resin carrier preferably has a volume average particle diameter of preferably from 15 to 80 μm and the magnetic powder preferably has a volume average particle diameter of from 0.1 to 10 μm.

The resin carrier has a true specific gravity of desirably from 1.5 to 4.0.

The resin carrier desirably contains the magnetic powder in an amount of from 20 to 95 parts by weight based on 100 parts by weight of the resin carrier.

The resin carrier desirably has a shape coefficient of from 1.0 to 2.5.

The resin carrier desirably has a magnetization of from 30 to 90 $Am^2/Kg$ (emu/g) in application at a magnetic field of 5000 $k/4\pi \cdot A/m$ (5 kOe) and a resistance of from $10^4\Omega$ to $10^{13}\Omega$ in application at an electric field of 5000 V/cm.

The surface of the resin carrier is desirably covered with a resin.

The two-component type developer for electrophotography of the invention comprises the above resin carrier and toner particles having a volume average particle diameter of from 3 to 15 μm.

The method for forming an image according to the invention comprises developing an electrostatic latent image using an alternating electric field by the two-component type developer for electrophotography.

DETAILED DESCRIPTION OF THE INVENTION

Figure 1:
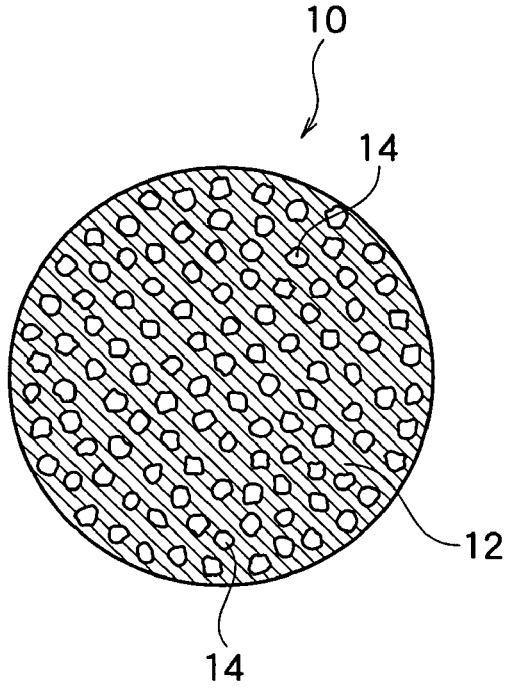
FIG. 1 is a schematic view showing the cross-section of a resin carrier of one embodiment of the present invention.

The resin carrier, the two-component developer and the method for forming an image using the two-component developer according to the present invention will be described in detail below.

In the following description, the properties of the binder resin materials and the properties of the resulting carrier particles were evaluated in the following methods.

Volume Average Particle Diameter

The volume average particle diameter of the carrier particles was measured using a laser-diffraction and scattering particle size distribution measuring apparatus (LS-230, manufactured by Beckman-Coulter, Inc.).

Magnetic Properties

The magnetic properties of the carrier particles were determined by measuring a magnetization at an applied magnetic field of 5000 k/4π·A/m (5 kOe) using an oscillation-type magnetometer (VSM-5-18, manufactured by Toei Industry Co., Ltd.).

True Specific Gravity and Bulk Density

The true specific gravity of the carrier particles was measured using a pycnometer in accordance with JIS R9301-2-1. The bulk density of the carrier particles was measured in accordance with JIS Z2504.

Shape Observation

The shapes of the carrier particles were confirmed by observation using a scanning electron microscope (JSM-6100 manufactured by JEOL Ltd.).

Shape Coefficient

The shape coefficient of the carrier particles was determined by taking an image of the carrier particles by means of a scanning electron microscope, analyzing the image by means of a image analysis soft (Image-Pro Plus, manufactured by Media Cybernetics) and calculating. The shape coefficient was represented by the following formula 1, and was determined per each particle. The average of the shape coefficients of 100 carrier particles was taken as the shape coefficient thereof.

$$\text{Shape coefficient} = \text{the largest diameter}/\text{the smallest diameter} \qquad \text{Formula 1}$$

In the formula 1, the largest diameter shows the largest diameter which links between two points present at the outer circumference of a particle through the center of gravity thereof, and the smallest diameter shows the smallest diameter which links between two points present at the outer circumference of a particle through the center of gravity thereof.

Charging Properties

The charged amount was measured on a mixture of a carrier and a toner using a suction type charged amount-measuring device (q/m-meter, manufactured by Epping GmbH PES-Laboratorium).

Electric Resistance

Non-magnetic flat and parallel electrodes (10 mm×40 mm) were placed in such a way that a N pole was opposite to a S pole with a magnetic pole distance of 2.0 mm, were filled with 200 mg of a specimen weighed. The magnetic poles (surface magnetic flux density: 1500 Gauss, counter electrode surface area: 10 mm×30 mm) were attached to the flat and parallel electrodes and thereby the specimen was kept between the electrodes. The electric resistance at an applied voltage of 1000 V was measured by an insulation-resistance meter (SM-8210 manufactured by DKK-TOA Co.).

Viscosity

The viscosity of the binder resin material was measured using a vibration type viscometer (VM-1G manufactured by Yamaichi Electronics Co., Ltd.).

Rate of Change in Specific Gravity

Using a measuring flask, 1 $cm^3$ of a mixture of the polysiloxane compound (A) and the polysiloxane compound (B) was weighed and the weight was taken as a specific gravity before heating. Successively, the mixture was heated at 120° C. for 5 hr to prepare a cured product. The cured product was sufficiently pulverized. The specific gravity of the pulverized product was measured using a pycnometer and taken as a specific gravity after the heating. The rate of change in specific gravity was determined by the following formula 2.

$$\text{Rate of change in specific gravity} = \text{Specific gravity after heating}/\text{Specific gravity before heating} \qquad \text{Formula 2}$$

Rate of Change in Weight

The weight of a mixture of the polysiloxane compound (A) and the polysiloxane compound (B) and the weight of the mixture obtained after heating at 120° C. for 5 hr were measured and the rate of change in the weight was determined by the following formula 3.

$$\text{Rate of change in weight} = \text{Weight after heating}/\text{Weight before heating} \qquad \text{Formula 3}$$

Amount of Byproduct Generated

Materials constituting the binder resin were mixed. 100 g of the mixture was heated from ordinary temperature to 120° C. at a temperature-elevating rate of 2° C./min. After the heating, the weight of the resulting binder resin was measured and the decreased weight was taken as an amount of byproducts generated.

The resin carrier of the invention is obtainable by mixing a binder resin material and a magnetic powder, suspending the mixture in an aqueous medium and curing. The binder resin material contains the polysiloxane compound (A) containing an epoxy group as a function group and the polysiloxane compound (B) having a functional group capable of ring-opening addition reaction with the epoxy group of the polysiloxane compound (A) Further, the binder resin is a silicone resin cured by the ring-opening addition reaction with the epoxy group and has a structure such that the magnetic powder is dispersed therein.

That is to say, the resin carrier 10 of the invention is formed from the silicone resin cured by the ring-opening addition reaction (ring opening addition reactant) 12 and the magnetic powder 14 dispersed in the silicone resin, as shown in FIG. 1.

By mixing the binder resin material and the magnetic powder, suspending the mixture in the aqueous medium and curing according to the invention, the shape of the resin carrier can be easily controlled and the resin carrier having a very narrow particle size distribution, a small amount of exposed magnetic powder, excellent fluidity and excellent capability of imparting charging to a toner can be prepared.

It is important for the polysiloxane compound (A) used herein to contain an epoxy group capable of ring opening as a functional group. The epoxy group-containing polysiloxane compound used herein is a compound substantially not having functional groups such as alkoxyl group and the like so as to induce no byproducts such as alcohol, water or the like in the reaction, preferably a compound containing no aromatic ring such as benzene ring or the like in the structure thereof. When the compound containing a benzene ring in the structure is used as a binder resin, the environmental stability for capability of imparting charging and the resistance to spent toner of the resin carrier are markedly deteriorated occasionally.

The epoxy group-containing polysiloxane compound has higher adhesion to the magnetic powder as compared with the epoxy group-free polysiloxane compound. Therefore, in the long time of printing, the magnetic powder is not released and the charging capability is slightly deteriorated The use of the polysiloxane compound as a binder resin can impart a desired electric charge to the toner momentarily because it lowers the critical surface tension of the resulting resin carrier, restrains the generation of toner spent condition and also increases the fluidity of the carrier.

Of these polysiloxane compounds, a polysiloxane compound having an epoxy group at least in the side chain is preferable, and a polysiloxane compound having at least two, or three or more epoxy groups in the side chain in one molecule is particularly preferable. The polysiloxane compound having plural crosslinking points in the side chain can form a tougher structure as compared with the same kind of compounds having a crosslinking point only at the end of the main chain, so as to improve the mechanical strength of the carrier. Accordingly, the carrier having little release of the magnetic powder and excellent durability can be prepared.

The polysiloxane compound (A) and the polysiloxane compound (B) are desirably contained in an amount of at least 90 parts by weight based on 100 parts by weight of the resin materials for constituting the binder. When the amount of them based on 100 parts by weight of the resin materials is less than 90 parts by weight, the crosslinked structures formed by ring opening addition reaction are decreased and the mechanical strength is easily lowered.

The epoxide equivalent weight of the polysiloxane compound (A) is usually from 200 to 1500 g/mol, preferably 300 to 900 g/mol, particularly preferably 400 to 700 g/mol. When the epoxide equivalent weight is less than 200 g/mol, unreacted epoxy groups remain and the difficulty of controlling the charging properties is easily induced. On the other hand, when the epoxide equivalent weight is over 1500 g/mol, the inadequacy of the strength as a resin is easily induced.

The epoxide equivalent weight of the polysiloxane compound (A) can be determined by, for example, dissolving a specimen of the polysiloxane compound (A) in methylethyl ketone, adding glacial acetic acid, adding trimethyl ammonium cetylbormide in large excess more than the equivalent weight and immediately carrying out titration with a glacial acetic acid solution of perchloric acid using a crystal violet as an indicator.

The polysiloxane compound (A) is desirably in a fluid state at room temperature and has a viscosity at 25° C. of not more than 10000 cP. When the viscosity is over 10000 cP, the polysiloxane compound (A) and the polysiloxane compound (B) are not mixed homogeneously in preparing the resin carrier by using the polysiloxane compound (A) and the polysiloxane compound (B) as essential materials for the binder resin, and thereby variation of the ring opening addition reaction occurs between the particles and inside the particles and thereby it is difficult to prepare carrier particles having a uniform composition. Therefore, the resin carriers having the desired properties cannot be obtained occasionally.

The epoxy group-containing polysiloxane compound (A) is reacted with the polysiloxane compound (B) having a functional group capable of ring opening addition reaction with an epoxy group, namely the polysiloxane compound (B) having active hydrogen in the functional group, by ring opening addition reaction. The polysiloxane compound (B) desirably has a functional group, which does not generate byproducts such as water, alcohol and the like by ring opening addition reaction, and is preferably a compound having a functional group, for example, an amino group, carboxyl group, mercapto group and carbinol group. That is to say, the polysiloxane compound (B) is a compound having at least one functional group selected from the above groups.

Specific examples of the polysiloxane compound (B) may include an amino modified silicone resin, amino modified silicone oil, amino modified silicone oligomer, carboxy modified silicone resin, carboxy modified silicone oil, carboxy modified silicone oligomer, mercapto modified silicone resin, mercapto modified silicone oil, mercapto modified silicone oligomer, carbinol modified silicone resin, carbinol modified silicone oil and carbinol modified silicone oligomer.

In particular, among them, the polysiloxane compound having an amino group, for example, amino modified silicone compound is preferably used because it has good reactivity and high strength after curing, induces no breakage of the carrier particles caused by stress generated in a developing apparatus and no release of the magnetic powder, and thereby the resulting resin carrier has excellent durability. As the amino group of the amino modified polysiloxane compound, any one of one kind of primary amino group and secondary amino group, a combination of primary amino group and secondary amino group, and primary amino group and secondary amino group simultaneously present in the same side chain group may be employed. Any one of them can harden the binder resin favorably so that the desired resin carrier can be prepared. Further, the use of a polysiloxane compound containing the above amino group, and tertiary amino group or quaternary ammonium salt can lead to the good results. Among these compounds, particularly, the polysiloxane compound containing at least primary amino group is preferred.

Furthermore, using the polysiloxane compound (B) having an amino group as a binder resin material, the charging capability inside the resin carrier particles becomes uniform, and even if the surface of the resin carrier will be partly released by stress suffered during using for a long period of time, the charging capability is changed slightly and the stable developer properties can be retained. In particular, the resin carrier prepared by using the polysiloxane compound (B) having an amino group has excellent charging capability to a negative toner and a high charging build up rate, and hardly causes fog or toner scattering.

The polysiloxane compound (B) may contain different kinds of functional groups in one molecule or may be a compound obtainable by combining a compound having a specific functional group and a compound having a functional group different form the specific functional group. However, the polysiloxane compounds (B) are compounds substantially not having a functional group such as alkoxyl group and the like so as to not generate byproducts such as alcohol or water in the reaction thereof with the polysiloxane compound (A).

Of the polysiloxane compounds having a group capable of reacting with such an epoxy group, a compound having a group capable of reacting with epoxy group in the side chain is preferred, and further, a compound having two or three or more side chain functional groups in molecule is preferred particularly. The polysiloxane compound having plural crosslinking points in the side chain can form a much sturdy structure as compared with the same kind of compounds having a crosslinking point at the end in the main chain, and can improve the mechanical strength of the carrier. Accordingly, the carrier having little release of the magnetic powder and excellent durability can be prepared.

In the polysiloxane compound (B) having a group capable of ring opening addition reaction with an epoxy group, the equivalent weight of a functional group capable of ring opening addition reaction with an epoxy group is generally from 100 to 4000 g/mol, preferably 200 to 1000 g/mol, particularly preferably 300 to 800 g/mol. When the functional group equivalent weight of the polysiloxane compound (B) is less than 100 g/mol, unreacted function groups remain and thereby the charging properties are apt to be controlled difficulty. When the functional group equivalent weight is over 4000 g/mol, the strength as a resin is apt to be insufficient.

The functional group equivalent weight of the polysiloxane compound (B) can be determined by using a specimen of the polysiloxane compound (B) in accordance with the quantitative analysis for each function group. For example, when the amino group equivalent weight of the polysiloxane compound (B) is determined, a specimen of the polysiloxane compound (B) is hydrolyzed with strong alkali, to be soluble in water and then the amino group is determined using an ion chromatograph and calculated.

When the carboxyl group equivalent weight of the polysiloxane compound (B) is determined, a specimen of the polysiloxane compound (B) is dissolved in toluene, and determined using a bromthymol blue and phenol red-mixed indicator by titrating with a 0.1 M potassium hydroxide alcohol solution previously standardized.

When the mercapto group equivalent weight of the polysiloxane compound (B) is determined, a specimen of the polysiloxane compound (B) is hydrolyzed with strong alkali to be soluble in water, colored with a coloring reagent such as nitrous acid or p-chloromethacryl benzoic acid and determined by the absorptiometry method.

When the carbinol group equivalent weight of the polysiloxane compound (B) is determined, it can be determined in accordance with a method for testing chemical products on acid value, saponification value, ester value, iodine value and hydroxyl value, and unsaponifiable products JIS-K0070.

The polysiloxane compound (B) is desirably in a fluid state at room temperature and has a viscosity at 25° C. of preferably not more than 10000 cP. When the viscosity is over 10000 cP, in preparing the resin carrier using the polysiloxane compound (A) and the polysiloxane (B) as essential materials for the binder resin, the polysiloxane compound (A) and the polysiloxane (B) are not mixed homogeneously and thereby the variation of the ring opening addition reaction occurs among the particles and in the particles, and it is difficult to prepare the carrier particles having a uniform composition. Resultantly, the resin carrier having the desired properties cannot be prepared occasionally.

In the present invention, the polysiloxane compound (A) and the polysiloxane compound (B) are used in an amount such that the ratio of the number of the functional groups of the polysiloxane compound (A) to that of the polysiloxane (B) (the number of epoxy groups of the polysiloxane compound (A) to the number of the functional groups of the polysiloxane (B) which functional groups are capable of ring opening addition reaction with the epoxy groups) is preferably from 0.3 to 3.0, more preferably 0.5 to 2.0. By using the polysiloxane compound (A) and the polysiloxane (B) in the above range of the functional group ratio, in the ring opening addition reaction, the reactive functional groups are reacted each other without very excess or deficiency and thereby the curing is caused properly and the desired resin carrier can be obtained.

The polysiloxane compound (A) having an epoxy group and the polysiloxane compound (B) having a functional group capable of ring opening addition reaction with the epoxy resin are controlled so that the ratio of the functional group number is in the above range, and subjected to ring opening addition reaction, and thereby the resulting carrier has excellent mechanical strength, no release of the magnetic powder and excellent resistance to spent toner and also the carrier and developer properties can be stabilized for a long period of time.

In the ring opening addition reaction of an epoxy resin, the infrared absorption spectrum (spectrum 1) of a mixture of the polysiloxane compound (A) and the polysiloxane compound (B) were measured using, for example, a Fourier transform infrared spectroscopy photometer (FT-IR). After the measurement, the mixture of the polysiloxane compound (A) and the polysiloxane compound (B) was heated at 120° C. for 5 hr to prepare a cured product. The infrared absorption spectrum (spectrum 2) of the cured product was measured similarly. From the comparison between the infrared absorption spectrums, it can be confirmed that absorption peaks inherent in the epoxy ring of the polysiloxane compound (A) are observed in the spectrum 1, on the other hand, the peak area is decreased markedly in the spectrum 2. This fact suggests that the chemical bonding is changed in such a way that the epoxy rings of the polysiloxane compound (A) are opened and addition reacted with the functional groups of the polysiloxane compound (B). From the suggestion, it is confirmed that the polysiloxane (A) and the polysiloxane (B) are cured through the ring opening addition reaction of epoxy rings.

In the present invention, the ring opening addition reaction may be carried out in combined use of a curing agent in order to control the crosslinking density and the reaction rate desirably. As the curing agent used herein, curing agents conventionally known can be used.

Examples thereof are:

aliphatic primary amines such as ethylene diamine, diethylene triamine, triethylene tetramine, tetraethylene pentamine, diethylamino propylamine, m-hexamethylene-triamine, Epomate (R) and 1,3-diaminomethyl cyclohexene;

aliphatic secondary amines such as piperidine, imidazole and polyamide amine;

aliphatic tertiary amines such as triethylamine, aminoethyl piperadine and tetramethyl guanidine;

aromatic primary amines such as m-phenylene diamine, diamino-diphenyl-methane and diamino-diphenyl-sulfone;

aromatic tertiary amines such as benzyl dimethylamine, 2,4,6-tris(dimethylaminomethyl)phenol and 2-methyl aminomethyl phenol;

modified amines such as amine-glycidyl ether adduct, amine-cyano-ethyl adduct and amine-phenyl-glycidyl-ether adduct;

acid anhydrides such as phthalic anhydride, maleic anhydride, hexahydro-phthalic anhydride, 3-methyl-1,2,3,6-tetrahydro-phthalic anhydride, 4-methyl-1,2,3,6-tetrahydro-phthalic anhydride, pyromellitic anhydride, trimellitic anhydride, trimellitic glycol, methyl nadic anhydride, chlorendic anhydride, dodecyl succinic anhydride, dichloromaleic anhydride, polyazelaic anhydride and polysebacic anhydride;

alcohols such as ethylene glycol, propylene glycol, polyethylene glycol and polyvinyl alcohol; and thiols such as liquid polysulfide and polymercaptan.

Of these, it is preferred to use the compounds having no aromatic ring because the environmental stability and the resistance to spent toner are not deteriorated. These curing agents may be used singly or in a combination of the plural curing agents.

These curing agents are used in amounts of preferably not more than 10 parts by weight, particularly preferably not more than 1 part by weight based on 100 parts by weight of the resins constituting the binder. When the curing agents are used in amounts of over 10 parts by weight, it is occasionally difficult to control the desired reaction rate, and further, the properties obtained by using the polysiloxane compounds are occasionally spoiled. That is, the overuse of the curing agents occasionally induces the case that the properties such as low critical surface tension, controlling the occurrence of toner spent conditions, enhancing the fluidity of the carrier and momentarily imparting desired charging to a toner are spoiled, and the capability as the carrier is lowered.

The binder resin phase may contain conventionally known various kinds of additives such as a crosslinking agent, charging controller, conductivity controller and fluidity controller in addition to the polysiloxane compound (A), the polysiloxane compound (B) and the curing agent.

Before and after heating the mixture of the polysiloxane compound (A) and the polysiloxane compound (B) at 120° C., the rate of change in specific gravity is desirably from 0.8 to 1.2. The compound having the rate of change in specific gravity in this range has a small change of the volume in curing and low crack occurrence in the carrier particles, good adhesion between the magnetic powder and the binder resin, and thereby the carrier particles having excellent mechanical strength can be prepared.

Before and after heating the mixture of the polysiloxane compound (A) and the polysiloxane compound (B) at 120° C., the rate of change in weight is desirably from 0.8 to 1.0. When the compound having a rate of change in weight of not more than 0.8 is used, voids are easily generated by release of byproducts with the reaction inside the carrier particles.

Except for the polysiloxane compound (B) having a functional group capable of ring opening addition reaction with an epoxy group of the polysiloxane compound (A), the binder resin may contain organosilane compounds having a functional group capable of ring opening addition reaction with an epoxy group of the polysiloxane compound (A) and submitted to use. These organosilane compounds preferably have at least one functional group selected from the group consisting of an amino group, carboxyl group, mercapto group and carbinol group. The organosilane compounds have the above functional groups, so that they have high reactivity with the polysiloxane compounds, can uniform the magnetic powder-dispersing condition in the binder resin and further improve the adhesion between the magnetic powder and the binder resin. Simultaneously, the compounds reinforce the binder resin phase after curing, and thereby the resin carrier particles having excellent mechanical strength can be more easily prepared. In particular, it is preferred to use the amino group containing organosilane compound because the compound advances the reactivity of the epoxy group containing polysiloxane compound. Furthermore, these organosilane compounds may be selected and used in combination taking account of the charging properties of a toner used with the resin carrier of the present invention.

The organosilane compounds are not particularly limited and examples thereof may include γ-aminopropyl trimethoxy silane, γ-aminopropyl triethoxy silane, N-β(aminoethyl)γ-aminopropyl trimethoxy silane, N-β(aminoethyl) γ-aminopropyl methyl dimethoxy silane, N-β(aminoethyl)γ-aminopropyl triethoxy silane, N-β(aminoethyl)γ-aminopropyl methyl diethoxy silane, chloro-γ-(trimethyl amino)propyl trimethoxy silane, chloro-γ-(trimethyl amino) propyl triethoxy silane, β(3,4-epoxycyclohexyl)ethyl trimethoxy silane, γ-glycidoxy propyl trimethoxy silane, γ-glycidoxy propyl methyl dimethoxy silane, γ-glycidoxy propyl triethoxy silane, γ-glycidoxy propyl methyl diethoxy silane, γ-mercapto propyl trimethoxy silane, γ-mercapto propyl methyl dimethoxy silane, γ-mercapto propyl triethoxy silane, γ-mercapto propyl methyl diethoxy silane, γ-carboxy propyl trimethoxy silane and γ-carboxy propyl triethoxy silane.

These organosilane compounds may be used singly or in combination with two or more. The organosilane compounds are used in amounts of usually not more than 10 parts by weight, preferably not more than 8 parts by weight, particularly preferably not more than 5 parts by weight based on 100 parts by weight of the silicone resin components constituting the binder. When the amount of the organosilane compounds is over 10 parts by weight, the amount of byproducts generated from the organosilane compounds is large in curing of the binder resin and voids or cracks are occasionally generated in the carrier particles.

The amount of the byproducts generated in the curing reaction of the binder resin is preferably less than 20 parts by weight, particularly preferably less than 15 parts by weight based on 100 parts by weight of the total of the compounds constituting the binder before the curing. When the amount of the byproducts is over 20 parts by weight, void are easily generated inside the carrier particles by release of the byproducts accompanying the reaction Conventionally, any of the polysiloxane compounds used as a binder resin of the magnetic powder dispersed binder type carriers are cured by crosslinking with polycondensation reaction. Therefore, a large amount of byproducts are generated in the curing, to cause voids inside the carrier particles. On this account, the binder resin has low mechanical strength and easy release of the magnetic powder, and thereby the carrier prepared from the polysiloxane compound has inferior durability.

The binder used in the present invention is suitable for preparing the carrier having low void generation inside the carrier particles, excellent mechanical strength, no easy release of the magnetic powder and excellent durability, because the amount of byproducts generated with the reaction is small.

As the magnetic powder used in the invention, conventionally known ones can be used. Examples of the magnetic powder used in the invention may include iron powder, iron nitride powder, nickel powder, Fe—Si alloy powder, Fe—Al—Si alloy powder, ferrite powder, magnetite powder, maghemite power, etc. The above magnetic powder has a volume average particle diameter of usually from 0.1 to 10 μm, preferably 1.0 to 8.0 μm. When the magnetic powder has a volume average particle diameter of less than 0.1 μm, the magnetic powder is remarkably aggregated due to van der Waals attraction and the like and then it is difficult to disperse the magnetic powder in the binder resin homogeneously. When the magnetic powder has a volume average particle diameter of over 10 μm, the magnetic powder protrudes from the resin carrier, the shape of the resin carrier deteriorates, and from the protrudent points, electric charge leaks out and furthermore the magnetic powder is easily released.

The magnetic powder is used in an amount of usually from 20 to 95 parts by weight, preferably 35 to 90 parts by weight based on 100 parts by weight of the resin carrier. When the amount of the magnetic carrier is less than 20 parts by weight, it is difficult to attain the desired magnetization. The amount is undesirably over 95 parts by weight because the magnetic powder is hardly dispersed in the resin carrier homogeneously. When the magnetic powder having the particle diameter in the above range is used in the above amount, the magnetic powder can be homogenously dispersed in the binder resin and the resin carrier having sufficient magnetic properties can be prepared.

Additionally, the magnetic powder used in the invention is preferably subjected to lipophilic treatment. The lipophilic treatment thereof improves the adhesion between the magnetic powder and the binder resin and decreases the release of the magnetic powder. The lipophilic treatment method may include a method of coating the magnetic powder with a material having high affinity with the binder resin and strongly adhering on the surface of the magnetic powder by heating treatment or the like.

Examples of the material having high affinity with the binder resin according to the invention may include known coupling agents such as silane coupling agent, aluminate coupling agent and titanate coupling agent. These may be used singly or in combination with two or more.

It is preferred to mix the mixture of the materials constituting the resin carrier homogenously by using a kneading apparatus such as roller, kneader and extruder.

The resin carrier of the invention can be prepared by suspending the above mixture in an aqueous medium and curing with ring opening addition reaction.

In the suspending of the mixture in the aqueous medium, a suspension stabilizer or a dispersant may be added to the aqueous medium in order to control the shape, particle diameter and particle size distribution of the resin carrier. Examples of the suspension stabilizer and dispersant are inorganic salts such as calcium phosphate, calcium carbonate and magnesium carbonate; water-soluble polymer compounds such as polyvinyl alcohol and polyethylene glycol; anionic surface active agents; cationic surface active agents; amphoteric surface active agents and nonionic surface active agents.

Examples of the anionic surface active agents are fatty acid salts such as sodium oleate and castor oil; alkyl sulfate esters such as sodium lauryl sulfate and ammonium lauryl sulfate; alkylbenzene sulfonates such as sodium dodecylbenzene sulfonate etc; alkyl naphthalene sulfonate; alkyl phosphate; naphthalene sulfonic acid formalin condensate and polyoxyethylene alkyl sulfate. Examples of the cationic surface active agents are alkylamine salts such as laurylamine acetate etc; and quaternary ammonium salts such as lauryl trimethyl ammonium chloride and stearyl trimethyl ammonium chloride. Examples of the amphoteric surface-active agents are amino carboxylate, alkyl amino acid and the like. Examples of the nonionic surface-active agents are polyoxyethylene alkyl ether, polyoxyethylene fatty acid ester, sorbitan fatty acid ester, polyoxy ethylene alkylamine, glycerin, fatty acid ester and oxyethylene-oxypropylene block copolymer.

The suspension stabilizer and dispersant are used in amounts of not more than 30 parts by weight, preferably not more than 20 parts by weight based on 100 parts by weight of the aqueous medium. When the amount of the suspension stabilizer or the dispersant is over 30 parts by weight, it is difficult to carry out the step of removing the suspension stabilizer and the dispersant and further occasionally, it exerts a bad influence upon the environmental dependency of the resulting carrier particles.

As the aqueous medium, which is a dispersion medium, water is usually used. Further, a small amount of various organic solvents such as methyl alcohol, ethyl alcohol and isopropyl alcohol is added to water to regulate the polarity and then may be submitted to use. The aqueous medium is used in an amount of usually from 100 to 1000 parts by weight, preferably 300 to 600, parts by weight based on 100 parts by weight of the mixture containing the polysiloxane compound (A), the polysiloxane compound (B), the magnetic powder, etc. When the amount of the aqueous medium is less than 100 parts by weight, the suspension stability of the mixture in the medium is occasionally lowered. When the amount thereof is over 1000 parts by weight, the productivity is occasionally lowered.

The mixture containing the polysiloxane compound (A), the polysiloxane compound (B) and the magnetic powder, and optionally the organosilane compound, the curing agent and other additives is suspended in the aqueous medium in which the suspension stabilizer and the dispersant have been previously added by using, for example, a mixing apparatus equipped with a stirring blade. The suspension particles of the suspended mixture have the particle diameter almost same as the particle diameter of the resulting resin carrier. Accordingly, it is desired to suspending the mixture in the aqueous medium as homogenously as possible.

The mixture is homogeneously suspended in the aqueous medium in the above manner and then heated, and thereby curing proceeds by ring opening addition reaction of epoxy groups of the suspension particles.

That is to say, the suspension thus prepared is heated at a temperature of usually not lower than 50° C. and lower than 100° C., preferably not lower than 70° C. and lower than 90° C., and thereby the curing reaction is started. When the heating temperature is lower than 50° C., the rate of ring opening addition reaction is slow and the productivity is lowered because the curing takes time. When the temperature is higher than 100° C. at ordinary pressure, the aqueous medium boils and thereby the reaction requires to be started under increased pressure. Therefore, many plants is required to carry out the reaction industrially. In such temperature conditions, the reaction time is usually from 1 to 10 hr.

After the reaction, the suspension is cooled to room temperature and the suspension stabilizer and the dispersant are removed from the suspension. For example, when calcium phosphate is used as the suspension stabilizer, it can be removed by acidifying the suspension with hydrochloric acid etc to dissolve calcium phosphate and then by washing with water repeatedly.

The suspension particles thus precipitated are separated by utilizing a usual solid liquid separation method such as filtration, pressure filtration and centrifugation.

The particles separated are dried and heated, and thereby the ring opening addition reaction of epoxy groups goes to completion.

That is to say, the resin carrier thus separated is heated to a temperature of usually from 100° C. to 300° C., preferably 120° C. to 250° C. and thereby the reaction goes to completion. In such temperature conditions, the reaction time is usually from 1 to 10 hr. When the temperature is lower than 100° C., the productivity is lowered because the completion of the reaction needs time. When the temperature is higher 300° C., the binder resin is deteriorated, so that the capability as a carrier is occasionally deteriorated.

After the reaction, the resin carrier is cooled to room temperature and optionally crushed and pulverized, and further classified to prepare the resin carrier of the present invention.

The resin carrier thus prepared has a volume average particle diameter of from 15 to 80 μm, preferably 20 to 60 μm, more preferably 20 to 50 μm. The particles having a volume average particle diameter of ±10 μm are present in an amount of usually not less than 50% by weight, preferably not less than 65% by weight, more preferably not less than 80% by weight based on the total particles obtained. When the volume average particle diameter is less than 15 μm, the carrier adheres to a photosensitive material and thereby image defects such as white spots etc are easily induced. When the volume average particle diameter is over 80 μm, the surface area is small and thereby the capability of imparting charging tends to be lowered.

The resin carrier of the invention has a true specific gravity of usually from 1.5 to 4.0, preferably 2.0 to 3.8, more preferably 2.2 to 3.7. When the true specific gravity is less than 1.5, the initial charging rate is slow and thereby toner scattering or fog is easily induced. When the true specific gravity is over 4.0, the stress inside a developing device is increased and thereby it is difficult to control the toner-spent condition.

The resin carrier has a bulk density of usually from 0.8 to 2.5 g/cm$^3$, preferably 0.9 to 2.2 g/cm$^3$, more preferably 1.0 to 2.0 g/cm$^3$. The resin carrier has a lower density than that of conventional iron powder carriers or ferrite carriers. Therefore, in the invention, the weight of the carrier is decreased and occurrence of the toner-spent condition can be controlled.

The resin carrier of the invention has a shape coefficient of usually from 1.0 to 2.5, preferably 1.0 to 2.0, particularly preferably 1.0 to 1.8. When the shape coefficient is over 2.5, the resin carrier is deteriorated in fluidity and cannot be homogeneously mixed and stirred with the toner particles, so that the charging properties are occasionally deteriorated.

The resin carrier of the invention has a magnetization at 5000 k/4π·A/m (5 kOe) of usually from 30 to 9.0 Am$^2$/kg (emu/g), preferably 35 to 80 Am$^2$/kg(emu/g), more preferably 50 to 75 Am$^2$/kg(emu/g). When the magnetization is less than 30 Am$^2$/kg(emu/g), adhesion of the carrier is easily induced. When the magnetization is over 90 Am$^2$/kg (emu/g), tips of a magnetic brush become too hard, so that the image quality tends to be lowered.

The resin carrier of the invention has a resistance at the time of applying an electric field of 5000 V/cm of usually from $10^4\Omega$ to $10^{13}\Omega$, preferably $10^5\Omega$ to $10^{12}\Omega$. When the resistance is less than $10^4\Omega$, electric charge leak is easily caused and image defects such as brush marks or white spots in a solid part are apt to be caused. When the resistance is over $10^{13}\Omega$, it is difficult to obtain the desired image density.

The resin carrier prepared by the above method has a smooth surface, a very narrow particle size distribution and excellent fluidity, so that it has excellent capability of imparting charging to a toner. Additionally, byproducts such as water, alcohol or the like are generated in a very small amount and also the rate of change in specific gravity and the rate of change in weight before and after the heating are very small. Therefore, voids and cracks are hardly generated inside the resin carrier and the resin carrier has excellent durability. Furthermore, because the pulverizing step and the highly precise classification step are unnecessary, the resin carrier has a high yield and excellent productivity.

Figure 2:
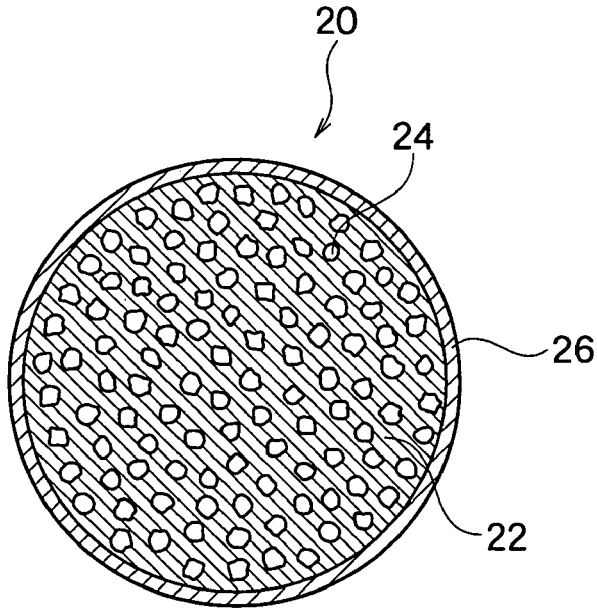
FIG. 2 is a schematic view showing the cross-section of a resin carrier of another embodiment of the invention.

The particles having a cross section as shown in FIG. 1 can be used for the resin carrier of the invention in the above manner, or as shown in FIG. 2, a coating layer 26 can be formed on the surface of a resin carrier 20. In FIG. 2, the number 22 shows a ring opening addition reactant (binder resin) and the number 24 shows magnetic powder.

As the method of forming the coating layer with such a resin, any conventionally known methods may be used. For example, the coating can be carried out by a brushing method, dry method, fluid bed spray dry method, rotary dry method or liquid immersion dry method with a universal stirrer, etc. Through the coating with the resin, the resin carrier having stable electric resistance and charged amount for a long time can be prepared. Furthermore, it is also possible to control the electric properties of the resin carrier by controlling the resin composition for forming the coating layer 26 and the additives contained in the resin composition.

As the coating resin for forming the resin coating, it is possible to use various kinds of resins conventionally known. Examples of the coating resin may include a fluorocarbon resin, acrylate resin, epoxy resin, polyester resin, fluoroacrylate resin, fluoroepoxy resin, acryl styrene resin and silicone resin; and modified silicone resins obtainable by modifying a resin such as acrylate resin, polyester resin, epoxy resin, alkyd resin, urethane resin or fluorocarbon resin.

Of these, the silicone resin and modified silicone resin are preferred because of having high compatibility and interlaminar adhesion with the binder resin for constituting the resin carrier of the invention. Furthermore, in order to have more stable developer properties for a long period of time and to hardly receive the influence by the sever conditions in a developing device, the coating resin preferably contains a resin having the same components as those of the binder resin for forming the resin carrier, that is, a modified silicone resin having an epoxy group or a modified silicone resin having a functional group capable of ring opening addition reaction with an epoxy group. When the coating resin contains the above modified silicone resin, the interlaminar adhesion between the resin carrier and the coating resin is enhanced and the durability is further improved. When the resin having such a structure is used, the abrasion resistance, peeling resistance and resistance to spent toner are well.

These coating resins are used on account of the polarity for imparting to the carrier. In order to improve the strength of these coating resins, a crosslinking agent such as oxime type one and the like can be contained in them.

Such a resin is used in an amount of usually from 0.01 to 10.0 parts by weight, preferably 0.3 to 7.0 parts by weight, more preferably 0.5 to 5.0 parts by weight based on 100 parts by weight of the above resin carrier particles. When the coating amount is less than 0.01 part by weight, it is difficult to form a uniform coating layer on the surface of the carrier. When the coating amount is over 10.0 parts by weight, aggregation of the carriers is easily generated to induce lowering of the productivity such as yield deterioration etc and also to cause change in the developer properties such as change in the fluidity of a developer in a developing device, charged amount of a developer, etc.

Further, the coating resin may contain a silane-coupling agent as a charging controlling agent. When the silane-coupling agent is used, it is possible to control the charging capability of the coating carrier. The kind of the silane-coupling agent usable for regulating the charging capability is not limited. However, an amino-silane coupling agent is preferable for the case of using a negative toner, and a fluorosilane-coupling agent is preferable for the case of using a positive toner. The silane-coupling agent is used in an amount of usually from 0.01 to 50 parts by weight, preferably 0.1 to 30 parts by weight based on 100 parts by weight of the resin used as a coating agent. When the added amount is too small, the effect of the charging controlling agent is not exhibited too clearly. When the added amount is too large, the charged amount is occasionally increased to excess by the stirring stress.

In the present invention, conductive fine particles are added into the coating resin, to control the electric resistance of the coating carrier. That is to say, when the coating amount of the resin is too large, the electric resistance of the coating carrier occasionally becomes very high and the developing capability of the developer is occasionally lowered. In this case, a small amount of the conductive fine particles is added to the coating agent for the coating carrier to control the electric resistance of the coating carrier. However, when the amount of the conductive fine particles is too large, electric charge leak is occasionally induced from the coating carrier due to the conductive fine particles because the electric resistance of the conductive fine particles is a lower resistance as compared with that of the coating resin or the core material. Therefore, the amount of the conductive fine particles added is usually from 0.25 to 20.0% by weight, preferably 0.5 to 15.0% by weight, particularly preferably 1.0 to 10.0% by weight.

Examples of the conductive fine particles usable in the invention may include inorganic conductive fine particles, such as conductive metal fine particles, conductive carbon and fine particle obtainable by doping antimony in oxides such as titanium oxide, tin oxide and the like. These may be used singly or in combination.

The two-component developer of the invention comprises the above resin carrier and the toner particles. The toner particles are classified into ground toner particles prepared by a grinding method and polymerized toner particles prepared by a polymerization method. In the invention, the toner particles prepared by any of the methods can be used.

The ground toner particles are prepared, for example, by sufficiently mixing a binder resin, a charge controlling agent and a coloring agent with a mixer such as Henschel mixer or the like, melt-kneading with a twin-screw extruder or the like and cooling, and thereafter grinding, classifying, adding an external agent, followed by mixing with a mixer, etc.

The binder resin constituting the toner particles is not particularly limited, and may include polystyrene, polychlorostyrene, styrene-chlorostyrene copolymer, styrene-acrylate copolymer, styrene-methacrylate copolymer, rosin-modified maleic resin, epoxy resin, polyester resin and polyurethane resin. These may be used singly or mixed.

As the charge-controlling agent, any agents can be used. For example, the charge-controlling agent for the positive charging toner may include Nigrosine type dyes, quaternary ammonium salt and the like, and the agent for the negative charging toner may include metal containing mono-azo dyes and the like.

As the coloring agent (colorant), dyes and/or pigments conventionally know can be used, and may include, for example, carbon black, phthalo-cyanine blue, permanent red, chrome yellow and phthalo-cyanine green. Additionally, an external agent such as silica powder, titania, etc can be added in accordance with the toner particles in order to improve the fluidity and the aggregation resistance of the toner.

The polymerized toner particles are particles prepared by a known method such as suspension polymerization method, emulsion polymerization method, etc. The polymerized toner particles can be prepared, for example, by mixing and stirring a colored dispersion solution prepared by dispersing a coloring agent in water with a surface active agent, a polymerizing monomer, a surface active agent and a polymerization initiator in an aqueous medium to emulsify and disperse the polymerizing monomer in the aqueous medium, and carrying out polymerization with stirring and mixing, and thereafter adding a salting agent, to carry out salting out of the polymer particles, filtering and washing the resulting particles prepared by the salting out, and further drying them. Thereafter, if necessary, an external agent may be added to the dried toner particles.

In preparing the polymerized toner particles, further, a fixing improver and a charging controlling agent can be added in addition to the polymerizing monomer, the surface-active agent, the polymerization initiator and the coloring agent. The addition of these agents can control and improve the various properties of the resulting polymerized toner particles. Furthermore, a chain transfer agent may be used in order to improve the dispersibility of the polymerizing monomer to the aqueous medium and control the molecular weight of the resulting polymer.

The polymerizing monomer used in preparing the polymerized toner particles is not particularly limited, and example thereof may include styrene and its derivative; ethylene unsaturated monoolefins such as ethylene and propylene; halogenated vinyls such as vinyl chloride; vinyl esters such as vinyl acetate; α-methylene aliphatic mono carboxylates such as methyl acrylate, ethyl acrylate, methyl methacrylate, ethyl methacrylate, 2-ethylhexyl methacrylate, dimethyl aminoacrylate and diethylaminomethacrylate.

As the coloring agent (colorant) used for controlling the polymerized toner particles, it is possible to use conventionally known dyes and/or pigments. Examples thereof may include carbon black, phthalo-cyanine blue, permanent red, chrome yellow and phthalo cyanine green and the like. The surfaces of these coloring agents may be modified using a surface-modifier such as a silane coupling agent, titanium coupling agent and the like.

As the surface-active agent used in preparing the polymerized toner particles, it is possible to use an anionic surface-active agent, cationic surface-active agent, amphoteric surface-active agent and nonionic surface-active agent.

Examples of the anionic surface active agent may include fatty acid salts such as sodium oleate and castor oil; alkyl sulfate esters such as sodium lauryl sulfate and ammonium lauryl sulfate; alkyl benzene sulfonates such as sodium dodecyl benzene sulfonate; alkyl naphthalene sulfonate; alkyl phosphate; naphthalene sulfonic acid formaline condensate and polyoxyethylene alkyl sulfate. Examples of the cationic surface-active agent may include alkylamine salts such as laurylamine acetate; and quaternary ammonium salts such as luryl trimethyl ammonium chloride and stearyl trimethyl ammonium chloride. Examples of the amphoteric surface-active agent may include amino carboxylate and alkyl amino acid. Examples of the nonionic surface-active agent may include polyoxyethylene alkyl ether, polyoxyethylene fatty acid ester, sorbitan fatty acid ester, polyoxyethylene alkyl amine, glycerin, fatty acid ester and oxyethylene-oxypropylene block polymer.

The surface-active agent can be used in an amount of usually from 0.01 to 10% by weight based on the polymerizing monomer.

The amount of the surface-active agent used has an effect on the dispersion stability of the monomer and also on the environmental dependency of the resulting polymerized toner particles. Therefore, the surface-active agent is preferably used in an amount such that the dispersion stability of the monomer can be secured and the environmental dependency of the resulting polymerized toner particles is hardly influenced.

In the preparation of the polymerized toner particles, a polymerization initiator is usually used. The polymerization initiators are classified into a waster soluble polymerization initiator and an oil soluble polymerization initiator. In the present invention, any of the initiators can be used. Examples of the water soluble polymerization initiator may include persulfates such as potassium persulfate and ammonium persulfate, and water soluble peroxide compounds, and examples of the oil soluble polymerization initiator may include azo compounds such as azo bisisobutyronitrile and the like, and oil soluble peroxide compounds.

In the present invention, in the case of using the chain transfer agent, for example, mercaptans such as octyl mercaptan, dodecyl mercaptan and tert-dodecyl mercaptan, and carbon tetrabromide are listed.

When the polymerized toner particles used in the invention contain the fixing improver, examples thereof are natural waxes such as carnauba wax and the like, and olefin waxes such as polypropylene and polyethylene.

When the polymerized toner particles used in the invention contain the charging controlling agent, the charging controlling agent used is not particularly limited and examples thereof may include Nigrosin-type dye, quaternary ammonium salts, organic metal complex, and metal containing monoazo dyes.

The external agent used for improving the fluidity of the polymerized toner particles may include silica, titanium oxide, barium titanate, fluorine containing fine particles and acrylate fine particles. These may be used singly or in combination.

The salting out agent used for separating the polymerization particles from the aqueous medium in the preparation of the polymerized toner particles may include metal salts such as magnesium sulfate, aluminum sulfate, barium chloride, magnesium chloride, calcium chloride and sodium chloride.

The toner particles thus prepared have a volume average particle diameter of from 3 to 15 μm, preferably 5 to 10 μm. When the toner particles having an average particle size of smaller than 3 μm, the charging capability is lowered, and fog and toner scattering are easily induced. When the toner particles having an average particle size of over 15 μm, the deterioration of the image quality is caused. The polymerized toner is preferred as a toner for constituting the developer of the present invention.

Because of having a narrow particle size distribution and high particle uniformity, the polymerized toner has a narrow charge distribution, and due to the use with the carrier of the present invention, a developer having more high fluidity can be prepared and the high image quality is easily attained.

The resin carrier and the toner particles thus prepared are mixed to prepare the electrophotography developer of the present invention. In this case, the concentration of the toner particles contained in the developer, namely, the toner concentration is preferably set in the range of from 5 to 15%. When the toner concentration is less than 5%, the desired image density is difficult to be obtained, and when it is over 15%, toner scattering and fog are easily generated.

The two-component developer for electrophotography according to the invention has a good toner charge build up and a stable charge with rare occurrence of toner spent conditions even after the use for a long period of time. That is, the two-component developer for electrophotography according to the invention has a good toner charge build up, no toner spent condition even after stirring for a long period of time and shows stable charge, preferably has a rate of change in charged amount represented by a ratio of charged amount after 600 min to charged amount after 1° min (rate of change in charged amount=value after 600 min/value after 1 min) of not less than 0.75 and not more than 1.5. The two-component developer for electrophotography has excellent environmental stability and preferably has a ratio of charged amount at a low temperature and a low humidity (10° C., 15% RH) to charged amount at a high temperature and a high humidity (35° C., 85% RH) (a charge ratio of charged amount at a low temperature and low humidity/charged amount at a high temperature and high humidity) ≧1.45.

The two-component developer for electrophotography thus prepared can be used for electrophotographyic apparatuses wherein electrostatic latent image formed on a photosensitive material having an organic photoconductor layer (copying machine, printer, facsimile, printing machine and the like). In particular, it is suitable for an image forming method of developing latent image with the toner particles while imparting a bias electric field having alternating current component and direct current component in a development part in the development region of a magnetic brush faced to the photosensitive material for holding latent image. Especially, the two-component developer for electrophotography is suitable for a developer of full colored machines, digital machines and the like in which the alternating field described above is used.

In the production of the carrier for electrophotography developers according to the invention, the amount of byproducts such as water, alcohol, etc is small, and the resulting carrier is free from release of the magnetic powder and has high mechanical strength, excellent durability and good environmental stability, and further can restrain the toner spent occurrence, and has good fluidity and excellent charging imparting capability to the toner.

Using the two-component developer of the present invention, the properties of the developer such as charged amount and the like can be stably maintained for a long period of time.

Additionally, developing a static latent image at alternate electric field using the two-component developer of the present invention, high-definition image quality can be obtained.

EXAMPLE

The present invention is described with reference to the following examples, but it should be not limited to these examples.

(Synthesis of Polysiloxane Compound)

The polysiloxane compound used in the present invention was synthesized in the following manner.

Synthesis Example 1

In the synthesis example, 100 parts by weight of water, 400 parts by weight of toluene and 100 parts by weight of lower alcohol (butyl alcohol and propyl alcohol mixed solution) were mixed and herein, a mixed solution of 400 parts by weight of dimethyldichlorosilane and 22 parts by weight of trimethyl chlorosilane was slowly dropped with stirring. After the dropping, the mixture was refluxed for 2 hr. The mixture was cooled to room temperature, and then the aqueous phase was removed and the oil phase washed with 600 parts by weight of a 10% sodium hydrogen carbonate aqueous solution once and with water four times to remove hydrochloric acid. To the oil phase, sodium sulfate was added and water was removed and thereafter, toluene was distilled off and a 50% toluene solution of polydimethyl siloxane was prepared. To the solution, 154 parts by weight of γ-glycidoxy propylmethyl dimethoxysilane, 1 part by weight of a 10% sodium hydroxide aqueous solution and 15 parts by weight of dimethyl formamide were added and refluxed for 3 hr. The mixture was cooled to room temperature, and acetic acid was added and a salt precipitated was separated with filtereation. The filtrate washed with water four times to remove excess acetic acid and thereafter, the solution was dried with sodium sulfate and toluene and dimethyl formamide were distilled off under reduced pressure to prepare an epoxy modified silicone (A-1) having a viscosity of 65 cP and an epoxide equivalent weight of 550 g/mol.

Synthesis Example 2

The procedure of Synthesis Example 1 was repeated except for using 194 parts by weight of dimethyl dichlorosilane to prepare an epoxy modified silicone (A-2) having a viscosity of 21 cP and an epoxide equivalent weight of 380 g/mol.

Synthesis Example 3

The procedure of Synthesis Example 1 was repeated except for using 710 parts by weight of dimethyl dichlorosilane to prepare an epoxy modified silicone (A-3) having a viscosity of 100 cP and an epoxide equivalent weight of 800 g/mol.

Synthesis Example 4

The procedure of Synthesis Example 1 was repeated except for using 1433 parts by weight of dimethyl dichlorosilane to prepare an epoxy modified silicone (A-4) having a viscosity of 200 cP and an epoxide equivalent weight of 1400 g/mol.

Synthesis Example 5

The procedure of Synthesis Example 1 was repeated except that 181 parts by weight of dimethyl dichlorosilane was used and 164 parts by weight of N-β(aminoethyl)γ-aminopropylmethyl dimethoxy silane was added in place of 154 parts by weight of γ-glycidoxy propylmethyldimethoxy silane, to prepare an amino modified silicone (B-1) having a viscosity of 30 cP and a functional group equivalent weight of 360 g/mol.

Synthesis Example 6

The procedure of Synthesis Example 5 was repeated except for using 90 parts by weight of dimethyl dichlorosilane, to prepare an amino modified silicone (B-2) having a viscosity of 21 cP and a functional group equivalent weight of 280 g/mol.

Synthesis Example 7

The procedure of Synthesis Example 5 was repeated except for using 1213 parts by weight of dimethyl dichlorosilane, to prepare an amino modified silicone (B-3) having a viscosity of 150 cP and a functional group equivalent weight of 1200 g/mol.

Example 1

For a binder resin material, 32.1 parts by weight of epoxy modified silicone (A-1), 17.8 parts by weight of amino modified silicone (B-1) and 1.6 parts by weight of γ-aminopropyl triethoxy silane were mixed and then the resulting binder resin material and 150 parts by weight of a particle size-regulated magnetite powder having a volume average particle diameter of 3.1 μm, which was a magnetic powder, were kneaded with a kneader to prepare a paste.

To 9 parts by weight of ion exchange water, 1 part by weight of calcium phosphate was suspended, and 3 parts by weight of the above paste was added to the suspension and stirred by a homogenizer for 5 min. After the stirring, the suspension was heated at 80° C. for 5 hr with stirring and then cooled to 25° C. Subsequently, hydrochloric acid was added to the suspension to dissolve calcium phosphate, and filtered to obtain a filter cake.

The resulting cake washed with water and then dried, cured at 170° C. for 5 hr, and disintegrated to prepare resin carrier particles. The particles were taken as a carrier 1 and the physical property values thereof were measured. The results are shown in Tables 1 and 2.

Example 2

62.3 parts by weight of epoxy modified silicone (A-1), 34.6 parts by weight of amino modified silicone (B-1) and 3.1 parts by weight of γ-aminopropyl triethoxy silane were mixed sufficiently. The resulting mixture was dissolved in 1000 parts by weight of toluene to prepare a coating resin solution. The coating was carried out using the coating resin solution and 10000 parts by weight of the resin carrier particles prepared in Example 1 with a fluidized bed coating apparatus. Thereafter, cure was carried out at 200° C. for 2 hr. The particles were taken as a carrier 2 and the physical property values were measured. The results are shown in Tables 1 and 2.

Example 3

The procedure of Example 1 was repeated except that 55.8 parts by weight of epoxy modified silicone (A-2), 40.5 parts by weight of amino modified silicone (B-2) and 7.8 parts by weight of γ-aminopropyl triethoxy silane were used as a binder resin material, and 100 parts by weight of magnetite powder is used as a magnetic powder, to prepare resin carrier particles. The particles were taken as a carrier 3 and the physical property values were measured. The results are shown in Tables 1 and 2.

Example 4

The procedure of Example 1 was repeated except that 75.8 parts by weight of epoxy modified silicone (A-3), 9.3 parts by weight of amino modified silicone (B-2) and 8.5 parts by weight of γ-aminopropyl triethoxy silane were used as a binder resin material, and 300 parts by weight of magnetite powder is used as a magnetic powder, to prepare resin carrier particles. The particles were taken as a carrier 4 and the physical property values were measured. The results are shown in Tables 1 and 2.

Example 5

The procedure of Example 1 was repeated except that 49.0 parts by weight of epoxy modified silicone (A-4), 35.9 parts by weight of amino modified silicone (B-3), 8.6 parts by weight of γ-aminopropyl triethoxy silane and 3.3 parts by weight of 3-methyl-1,2,3,6-tetrahydro phthalic anhydride were used as a binder resin material, and 300 parts by weight of magnetite powder is used as a magnetic powder, to prepare resin carrier particles. The particles were taken as a carrier 5 and the physical property values were measured. The results are shown in Tables 1 and 2.

Comparative Example 1

To 100 parts by weight of iron (III) oxide, 100 parts by weight of water and 1 part by weight of polyvinylalcohol were added and pulverized by a wet ball mill for 24 hr to prepare a slurry. The slurry was granulated, dried and held in an nitrogen atmosphere at 1300° C. for 6 hr, and thereafter, ground and subjected to particle size regulation, to prepare magnetite particles. Next, 93 parts by weight of epoxy modified silicone (A-1) as described in Synthesis Example 1, 53 parts by weight of amino modified silicone (B-1) as described in Synthesis Example 5, 4 parts by weight of γ-aminopropyl triethoxy silane and 0.1 part by weight of 3-methyl-1,2,3,6-tetrahydro phthalic anhydride were mixed sufficiently. 100 parts by weight of the resulting mixture was dissolved in 1000 parts by weight of toluene to prepare a coating resin solution. The coating was carried out using the coating resin solution and 10000 parts by weight of the magnetite particles by a fluidized bed coating apparatus. Thereafter, cure was carried out at 220° C. for 2 hr and thereby resin coated carrier particles were prepared. The particles were taken as a carrier 6 and the physical property values were measured. The results are shown in Tables 1 and 2.

Comparative Example 2

For a binder resin material, 100 parts by weight of alkoxy modified silicone (SR-2402, manufactured by Dow corning Toray Silicone Co., Ltd.), 15 parts by weight of γ-aminopropyl triethoxy silane and 4 parts by weight of dibutyl tin laurylate and for a magnetic powder, 300 parts by weight of particle size-regulated magnetite fine particles having a volume average particle diameter of 0.75 μm were kneaded with a kneader to prepare a paste.

To 20 parts by weight of ion exchange water, 2 parts by weight of calcium phosphate was suspended, and 1 part by weight of the above paste was added to the suspension and stirred by a homogenizer for 2 min. After the stirring, the suspension was heated at 80° C. for 2 hr and then cooled to 25° C. Subsequently, hydrochloric acid was added to the suspension to dissolve calcium phosphate, and filtered to obtain a filter cake.

The resulting cake was dried, cured at 80° C. for 2 hr, and disintegrated to prepare resin carrier particles. The particles were taken as a carrier 7 and the physical property values thereof were measured. The results are shown in Tables 1 and 2.

Comparative Example 3

Previously, 70 parts by weight of styrene, 20 parts by weight of methyl methacrylate, 2 parts by weight of divinyl benzene, 8 parts by weight of diethylene glycohol dimethacrylate, 6 parts by weight of 2,2'-azobis-(2,4-dimethylvaleronitrile), 0.5 part by weight of dilauroyl peroxide and 50 parts by weight of magnetite powder were mixed and degassed under reduce pressure. This mixture was added into a reactor in which a suspension composed of 1200 parts by weight of ion exchange water, 80 parts by weight of calcium phosphate and 0.5 part by weight of sodium lauryl sulfate was charged, and stirred by a homogenizer in a nitrogen atmosphere for 5 min. After the stirring, the resulting slurry was heated in a nitrogen atmosphere at 80° C. for 5 hr and then cooled to 25° C. Subsequently, hydrochloric acid was added to the slurry to dissolve calcium phosphate, and filtered, to obtain a filter cake.

The resulting cake was dried, to prepare resin carrier particles. The particles were taken as a carrier 8 and the physical property values thereof were measured. The results are shown in Tables 1 and 2.

Comparative Example 4

Previously, 400 parts by weight of epoxy modified silicone resin (ES1001N Shin-Etsu Chemical Co., Ltd, resin solid component 45% by weight, epoxide equivalent weight 1700 g/mol) for a binder resin and 270 parts by weight of magnetite powder as shown in Example 1 for a magnetic powder were mixed, and then a resin solvent was distilled off while the mixture was heated and kneaded at 80° C., and a solid was prepared. The solid was allowed to stand for cooling, and thereafter pulverized, classified and cured with heating at 120° C. for 2 hr and then was crushed and subjected to particle size regulation to prepare carrier particles. The particles were taken as a carrier 9 and the physical property values thereof were measured. The results are shown in Tables 1 and 2.

TABLE 1

| | | Magnetization (emu/g) | True specific gravity | Bulk density (g/cm$^3$) | Volume average particle diameter (μm) | Shape coefficient | Resistance (Ω) |
|---|---|---|---|---|---|---|---|
| Ex. 1 | Carrier 1 | 70 | 2.47 | 1.72 | 44.8 | 1.47 | $6.8 \times 10^{10}$ |
| Ex. 2 | Carrier 2 | 70 | 2.46 | 1.69 | 46.8 | 1.46 | $5.4 \times 10^{11}$ |
| Ex. 3 | Carrier 3 | 45 | 1.58 | 0.95 | 47.2 | 1.27 | $7.9 \times 10^{12}$ |
| Ex. 4 | Carrier 4 | 71 | 2.50 | 1.74 | 43.2 | 1.52 | $5.4 \times 10^{11}$ |
| Ex. 5 | Carrier 5 | 70 | 2.44 | 1.70 | 47.3 | 1.21 | $4.0 \times 10^{11}$ |
| Com. Ex. 1 | Carrier 6 | 91 | 4.94 | 2.59 | 66.7 | 1.34 | $3.2 \times 10^{9}$ |
| Com. Ex. 2 | Carrier 7 | 57 | 2.87 | 1.36 | 40.2 | 1.09 | $8.0 \times 10^{9}$ |
| Com. Ex. 3 | Carrier 8 | 28 | 1.27 | 0.78 | 48.5 | 1.16 | $7.4 \times 10^{14}$ |
| Com. Ex. 4 | Carrier 9 | 51 | 2.30 | 1.12 | 74.8 | 2.86 | $1.0 \times 10^{10}$ |

TABLE 2

| | | Rate of Change in Specific gravity before and after heating | Rate of Change in Weight before and after heating | Amount of Byproduct (wt part) |
|---|---|---|---|---|
| Ex. 1 | Carrier 1 | 1.09 | 0.95 | 7.2 |
| Ex. 2 | Carrier 2 | 1.10 | 0.97 | 8.6 |
| Ex. 3 | Carrier 3 | 1.11 | 0.96 | 8.7 |
| Ex. 4 | Carrier 4 | 1.13 | 0.90 | 18.3 |
| Ex. 5 | Carrier 5 | 1.05 | 0.95 | 19.1 |
| Com. Ex. 1 | Carrier 6 | — | — | — |
| Com. Ex. 2 | Carrier 7 | 1.33 | 0.72 | 27.3 |
| Com. Ex. 3 | Carrier 8 | 1.25 | 0.93 | 5.4 |
| Com. Ex. 4 | Carrier 9 | 1.10 | 0.39 | 56.3 |

With regard to Comparative Examples 2, 3 and 4, the rate of change in specific gravity, the rate of change in weight and the amount of byproducts of the binder resin used in each example were shown.

In Comparative Example 4, a diluted solvent was contained as a vanish so that the values were those of the carrier containing volatile components of the solvent.

Properties of Developer 90 parts by weight of each particulate carrier and 10 parts by weight of a commercially available polyester toner (toner for CF-70: manufactured by Minolta Co., Ltd. Volume average particle diameter: 9.8 μm) were put into a 10 cc sample bottle and shaked for 10 hr at an amplitude of 5 cm and frequency of 22.5 Hz. During this procedure, each predetermined time, the sample was taken out and the charged amount was measured at ordinary temperature under ordinary humidity (23° C./55% RH) using a suction type charging amount measuring apparatus (q/m-meter, manufactured by Epping GmbH PES-Laboratorium, and thereby the durability was evaluated as a developer. After the 10 hr shaking, the surface of the developer was observed and thereby the appearance of toner spent condition to the carrier was confirmed.

Furthermore, different from this observation, samples were shaked for 60 min at a high temperature under high humidity (35° C./85% RH) and at a low temperature under low humidity (10° C./15% RH) respectively and each charged amount thereof was measured in the same manner as above. The charged amount ratio of the charged amount at a low temperature under low humidity to the charged amount at a high temperature under high humidity was determined. The results of evaluating the toner spent condition and the above results are shown Tables 3 and 4.

Evaluation of Toner Spent Condition

Using an electron microscope (JSM-6100 model: manufactured by JEOL Co., Ltd), a reflection electronic image was taken at an applied voltage of 5 kV and the toner spent condition was visually observed.

A: Toner spent condition was scarcely observed.

B: Toner spent condition was slightly observed.

C: Toner spent condition was observed but was within the permissible range.

D: Toner spent condition was greatly observed.

E: Toner spent condition was highly observed.

TABLE 3

| | | Toner spent condition | Charged amount (μC/g) | | | | | |
|---|---|---|---|---|---|---|---|---|
| | | After 10 hr. stirring | 1 min value | 10 min value | 60 min value | 600 min value | Coefficient of change | Charged amount ratio (under low temperature and low humidity/ under high temperature and high humidity) |
| Ex. 1 | Carrier 1 | A | 13.0 | 16.0 | 15.7 | 15.5 | 1.19 | 1.21 |
| Ex. 2 | Carrier 2 | A | 13.3 | 15.6 | 15.5 | 15.1 | 1.14 | 1.28 |
| Ex. 3 | Carrier 3 | B | 12.2 | 15.4 | 15.5 | 15.4 | 1.26 | 1.39 |
| Ex. 4 | Carrier 4 | B | 14.5 | 15.6 | 15.0 | 17.3 | 1.19 | 1.36 |
| Ex. 5 | Carrier 5 | C | 11.9 | 12.8 | 13.0 | 9.5 | 0.80 | 1.40 |
| Com. Ex. 1 | Carrier 6 | D | 15.7 | 13.9 | 12.5 | 4.8 | 0.31 | 1.63 |
| Com. Ex. 2 | Carrier 7 | C | 19.9 | 12.0 | 4.9 | 2.5 | 0.13 | 1.87 |

TABLE 3-continued

| | | Toner spent condition | Charged amount (μC/g) | | | | | |
|---|---|---|---|---|---|---|---|---|
| | | After 10 hr. stirring | 1 min value | 10 min value | 60 min value | 600 min value | Coefficient of change | Charged amount ratio (under low temperature and low humidity/ under high temperature and high humidity) |
| Com. Ex. 3 | Carrier 8 | E | 9.1 | 8.5 | 7.3 | 1.5 | 0.16 | 1.74 |
| Com. Ex. 4 | Carrier 9 | D | 8.3 | 9.6 | 6.4 | 5.8 | 0.70 | 1.84 |

As is clear from Tables 3 and 4, in the case of using the carrier particles of the present invention as a developer, the build up of the toner charge is good and even after stirring for a long time, the toner spent condition is not caused and the stable charged amount is shown, preferably the rate of change in charged amount satisfies the following formula; 0.75≧rate of charge in charged amount=600 min value/1 min value≧1.5.

Furthermore, the use of the carrier particles of the invention has excellent environmental stability, preferably the charged amount ratio satisfies the following formula; Charged amount at a low temperature under low humidity/ Charged amount at a high temperature under high humidity≧1.45

Evaluation of Printing

The resulting carrier and commercially available toners for CF-70 manufactured by Minolta co., Ltd (magenta, cyan, yellow and black) were respectively mixed in a 10% toner concentration to prepare two-component developers.

With respect to the resulting two-component developers, using a commercially available machine (CF-70 manufactured by Minolta co., Ltd.) whose toner concentration sensor output setting was changed, a durability test for 10000 sheets of paper (sometimes shown as 1.0 k if 1000 sheets is expressed by 1 k) was carried out. After the durability test, the image evaluation on image density, fog, toner scattering, carrier adhesion (white spot) and resolution, and the general evaluation of the two component developers based on the evaluation are shown in Table 5. The evaluation in Table 5 was carried out with ranking. The rank C or higher rank is a level practically having no problem. The specific evaluation methods are shown below.

Image Density

The printed image prepared by output under fair developing conditions was evaluated on the image density.

The image density of a solid part was measured by X-Rite (Model 938 Manufactured by X-Rite Inc.) and was ranked.

A: The image density is very good.

B: The image density is within the range of the aimed image density.

C: Although the image density is somewhat low, the printed image is usable.

D: The image density is under the lower limit of the aim.

E: The image density is very low and the printed image is unusable.

Fog

The printed image prepared by output under fair developing conditions was evaluated on the fog concentration using a color difference meter Z-300A (manufactured by Nippon Denshoku Industries Co., Ltd).

A: less than 0.5

B: not less than 0.5 and less than 1.0

C: not less than 1.0 and less than 1.5

D: not less than 1.5 and less than 2.0

E: not less than 2.0

Toner Scattering

The condition of toner scattering in an apparatus was observed visually and was ranked.

A: Toner scattering is not entirely observed.

B: Toner scattering is observed slightly.

C: Toner scattering is observed at the limit.

D: Toner scattering is observed much.

E: Toner scattering is observed very much.

Carrier Scattering

The carrier adhesion and white spot level on the image were evaluated.

A: White spot is not observed in 10 sheets of A3 paper

B: 1 to 5 white spots are observed in 10 sheets of A3 paper.

C: 6 to 10 white spots are observed in 10 sheets of A3 paper.

D: 11 to 20 white spots are observed in 10 sheets of A3 paper.

E: at least 21 white spots are observed in 10 sheets of A3 paper.

Resolution

The printed image prepared by output under fair developing conditions was observed visually and was ranked.

A: very high

B: high

C: practical level

D: low

E: very low

Overall Evaluation

After the 10 k durability test, the overall evaluation was carried out from the image evaluation and the durability test and was ranked.

A: Through the 10 k durability test, very good image is maintained without change from the beginning.

B: Through the 10 k durability test, the change is observed on some evaluation items as compared with the beginning but the properties are stable without vast changing.

C: Through the 10 k durability test, the change is observed on each of the items, but the properties are on a practical level out of problems.

D: Through the 10 k durability test, the large change is observed on each of the items, and the properties are on an unpractical level.

E: From the beginning, some items are on an unpractical level, or the properties are vastly changed and do not have the 10 k durability.

TABLE 5

| | Image density | Fog | Toner scattering | Carrier scattering | Resolution | Overall evaluation |
|---|---|---|---|---|---|---|
| Ex. 1 | A | B | B | A | A | A |
| Ex. 2 | A | A | A | A | A | A |
| Ex. 3 | C | B | B | C | B | B |
| Ex. 4 | C | B | C | B | B | B |
| Ex. 5 | A | C | C | C | C | C |
| Com. Ex. 1 | B | C | D | C | E | D |
| Com. Ex. 2 | B | D | E | D | D | D |
| Com. Ex. 3 | E | E | D | E | D | E |
| Com. Ex. 4 | C | D | E | D | D | D |

The invention claimed is:

1. A carrier for electrophotography developers comprising a magnetic powder dispersed binder resin, which carrier is obtainable by mixing a binder resin material and a magnetic powder, suspending a resulting mixture in an aqueous medium and curing, wherein the binder resin material comprises:

(A) a polysiloxane compound having an epoxy group as a functional group having an epoxy group has an epoxide equivalent weight of from 200 to 1500 g/mol, (B) a polysiloxane compound having a group capable of ring-opening addition reaction with the epoxy group of the polysiloxane compound (A) comprising at least one group selected from an amino group, carboxyl group, mercapto group and carbinol group, and the binder resin is a silicone resin prepared by hardening with ring-opening addition reaction of an epoxy group.

2. The carrier for electrophotography developers according to claim 1 wherein the ratio of the number of functional groups of the polysiloxane compound (A) to the number of functional groups of the polysiloxane compound (B) (the number of epoxy groups of the polysiloxane groups (A)/the number of functional groups of the polysiloxane group (B) which functional groups are capable of ring-opening addition reaction with the epoxy groups) is in the range of from 0.3 to 3.0.

3. The carrier for electrophotography developers according to claim 1 wherein a mixture of the polysiloxane (A) and the polysiloxane (B) has a rate of change in specific gravity before and after heating of from 0.8 to 1.2.

4. The carrier for electrophotography developers according to claim 1 wherein a mixture of the polysiloxane (A) and the polysiloxane (B) has a rate of change in weight before and after heating of from 0.8 to 1.0.

5. The carrier for electrophotography developers according to claim 1 wherein in curing of the binder resin material, a byproduct is produced in an amount of less than 20 parts by weight based on 100 parts by weight of the weight of the compounds constituting the binder resin before curing.

6. The carrier for electrophotography developers according to claim 1 wherein the carrier for electrophotography developers has a volume average particle diameter of from 15 to 80 μm, and the magnetic powder contained in the carrier for electrophotography developers has a volume average particle diameter of from 0.1 to 10 μm.

7. The carrier for electrophotography developers according to claim 1, which has a true specific gravity of from 1.5 to 4.0.

8. The carrier for electrophotography developers according to claim 1, which contains the magnetic powder in an average amount of from 20 to 95 parts by weight based on 100 parts by weight of the carrier.

9. The carrier for electrophotography developers according to claim 1, which has a shape coefficient of from 1.0 to 2.5.

10. The carrier for electrophotography developers according to claim 1, which has a magnetization of from 30 to 90 $Am^2/Kg$ in application at a magnetic field of 5000 $k/4\pi \cdot A/m$ and a resistance of from $10^4\Omega$ to $10^{13}\Omega$ in application at an electric field of 5000 V/cm.

11. The carrier for electrophotography developers according to claim 1, which surface is covered with a resin.

12. A two-component developer for electrophotography which developer comprises a carrier for electrophotography developers as claimed in claim 1, and toner particles having a volume average particle diameter of from 3 to 15 μm.

13. A method for forming an image which method comprises developing a static latent image using an alternating electric field by a two-component developer for electrophotography as claimed in claim 12.

14. A carrier for electrophotography developers comprising a magnetic powder dispersed binder resin, which carrier is obtainable by mixing a binder resin material and a magnetic powder, suspending a resulting mixture in an aqueous medium and curing, wherein the binder resin material comprises:

(A) a polysiloxane compound having an epoxy group as a functional group, and (B) a polysiloxane compound having a group capable of ring-opening addition reaction with the epoxy group of the polysiloxane compound (A) comprising at least one group selected from an amino group, carboxyl group, mercapto group and carbinol group, wherein the polysiloxane group (B) having a group capable of ring-opening addition reaction with an epoxy group has an equivalent weight of a function group capable of ring-opening addition reaction with an epoxy group of from 100 to 4000 g/mol, and the binder resin is a silicone resin prepared by hardening with ring-opening addition reaction of an epoxy group.

15. The carrier for electrophotography developers according to claim 14, wherein the ratio of the number of functional groups of the polysiloxane compound (A) to the number of functional groups of the polysiloxane compound (B) (the number of epoxy groups of the polysiloxane groups (A)/the number of functional groups of the polysiloxane group (B) which functional groups are capable of ring-opening addition reaction with the epoxy groups) is in the range of from 0.3 to 3.0.

16. The carrier for electrophotography developers according to claim 14, wherein a mixture of the polysiloxane (A) and the polysiloxane (B) has a rate of change in specific gravity before and after heating of from 0.8 to 1.2.

17. The carrier for electrophotography developers according to claim 14, wherein a mixture of the polysiloxane (A) and the polysiloxane (B) has a rate of change in weight before and after heating of from 0.8 to 1.0.

18. The carrier for electrophotography developers according to claim 14, wherein in curing of the binder resin material, a byproduct is produced in an amount of less than 20 parts by weight based on 100 parts by weight of the weight of the compounds constituting the binder resin before curing.

19. The carrier for electrophotography developers according to claim 14, wherein the carrier for electrophotography developers has a volume average particle diameter of from 15 to 80 μm, and the magnetic powder contained in the carrier for electrophotography developers has a volume average particle diameter of from 0.1 to 10 μm.

20. The carrier for electrophotography developers according to claim 14, which has a true specific gravity of from 1.5 to 4.0.

21. The carrier for electrophotography developers according to claim 14, which contains the magnetic powder in an average amount of from 20 to 95 parts by weight based on 100 parts by weight of the carrier.

22. The carrier for electrophotography developers according to claim 14, which has a shape coefficient of from 1.0 to 2.5.

23. The carrier for electrophotography developers according to claim 14, which has a magnetization of from 30 to 90 $Am^2/Kg$ in application at a magnetic field of 5000 $k/4\pi \cdot A/m$ and a resistance of from $10^4\Omega$ to $10^{13}\Omega$ in application at an electric field of 5000 V/cm.

24. The carrier for electrophotography developers according to claim 14, which surface is covered with a resin.

25. A two-component developer for electrophotography which developer comprises a carrier for electrophotography developers as claimed in claim 14, and toner particles having a volume average particle diameter of from 3 to 15 μm.

26. A method for forming an image which method comprises developing a static latent image using an alternating electric field by a two-component developer for electrophotography as claimed in claim 25.

* * * * *